US005087211A

United States Patent [19]

Prunier et al.

[11] Patent Number: 5,087,211

[45] Date of Patent: Feb. 11, 1992

[54] MINIATURE CONNECTOR FOR FLAT METAL-CLAD CABLES AND CONTACT DEVICES FORMING THEM

[75] Inventors: Jean-Claude Prunier, Herblay; Pascal Peuchet, Carrieres Sur Seine; Jean-Jacques Le Gouic Martun, Esvres; Claude Bonnin, Monts, all of France

[73] Assignee: Societe Nouvelle De Connexion, Boulogne Billancourt, France

[21] Appl. No.: 603,306

[22] Filed: Oct. 25, 1990

[30] Foreign Application Priority Data

Oct. 25, 1989 [FR] France ..... 89 13987

[51] Int. Cl.[5] ..... H01R 13/00

[52] U.S. Cl. ..... 439/579

[58] Field of Search ..... 439/578-585

[56] References Cited

U.S. PATENT DOCUMENTS 3,243,760 3/1966 Dupre et al. ..... 439/579

4,614,398 9/1986 Wright et al. ..... 439/579

*Primary Examiner*—Joseph H. McGlynn

*Attorney, Agent, or Firm*—Pollock, Vande Sande & Priddy

[57] ABSTRACT

The invention relates to a miniature connector for metal clad cables and more especially, for flat cables comprising a stack of three elements of which one is a high-voltage conductor and the two others are low-voltage equipotential conductors.

14 Claims, 2 Drawing Sheets

MINIATURE CONNECTOR FOR FLAT METAL-CLAD CABLES AND CONTACT DEVICES FORMING THEM

FIELD OF THE INVENTION

The invention relates to a miniature connector for metal clad cables, and more especially for flat cables comprising a stack of three elements of which one is a high-voltage conductor and the two others are low-voltage equipotential conductors.

BACKGROUND OF THE INVENTION

Numerous connectors for flat cables have been developed. For example, reference may be made, e.g., to French Patent Application No. 2 618 263, filed on July 16, 1987, to U.S. patent application No. 4,773,878, filed July 2, 1987, and to French Patent No. 2 600 828, filed June 24, 1986.

It is generally observed that existing connectors basically allow connections at cable ends by ensuring nothing more than the coupling of low-voltage electrical connections with high contact quality.

Generally, therefore, these connectors are not morphologically adapted to flat metal-clad cables in which three conductors are stacked.

In fact, the recent creation of flat cables which incorporate printed circuit technology and which therefore comprise a stack of superposed conductive layers having slight thickness (typically 35 μm) requires the development of a contact-reestablishment device which alters neither mechanically nor thermally the conductive pathways in the cable or their insulating support. This characteristic is not provided with complete assurance in conventional connectors, which are, moreover, necessarily bulky.

As a result, a new need has been created, since conventional coaxial cables incorporating a cylindrical section have been replaced by flat metal-clad cables comprising a stack of three conductors, of which one is a high-voltage conductor and the two others are low-voltage, equipotential connectors. The substitution of the new cables is intended, moreover, to reduce the bulkiness of high-voltage cables.

SUMMARY OF THE INVENTION

Applicant has thus set for itself the problem of creating the smallest possible connectors which simultaneously provide for the reestablishment of contact with no mechanical or thermal alteration of the conductive pathways in this type of cable or of its insulating support.

Applicant has designed a connector which does not present the aforementioned problems and which possesses, in addition, the dielectric properties required to transfer a high level of pulsed energy. This energy may, for example, have a duration of approximately 1 μs under voltage of approximately 3500 V and with an output approaching 1000 amps at any pressure, since the conductor is completely air-tight.

The object of the invention is, more particularly, a male contact device connected to a flat metal-clad cable comprising a stack of three conductors, one high-voltage conductor and two low-voltage equipotential conductors, and which comprises:

one electrically conductive male contact at the end of the high-voltage conductor;

one fork made of a shape-retention material capable of holding the high-voltage conductor immobilized; and an oblong-sectioned ring made of a shape-retention material capable of ensuring, first, the junction and equipotentiality of the low-voltage conductors of the cable, and second, the continuity of the transfer of ground to the ground of a device to which it may be connected.

Another object of the invention is a male contact device which also comprises an insulating element conferring on this male device good mechanical resistance and the desired dielectric properties.

Yet another object of the invention is a female contact device connected to a coaxial cable and comprising:

a central female contact forming an electrically-conductive elastic clamp connected on the coaxial cable side to the central high-voltage conductor of the cable;

an insulating, elastic body surrounding the central female contact and capable of providing electrical insulation and impermeability: and a device for the transfer of ground positioned at the end of the insulating body.

The female contact device further comprises a locking device ensuring the retention of a male device capable of being connected to the female device.

A further object of the invention is a miniature connector for flat metal-clad cables comprising a stack of three conductors, of which one is a high-voltage conductor and the other two are low-voltage equipotential conductors, the connector being designed to electrically connect the flat cable to another type of cable or to an electrical apparatus and comprising:

a. a first connection device, termed a male device, comprising:

on the functional side, an elongated, electrically-conductive male contact at the end of the high-voltage conductor;

on the cable side, a fork made of a shape-retention material and whose shape is designed to hold the high-voltage conductor immobilized;

an oblong-sectioned ring made of a shape-retention material capable of ensuring, first, the junction and equipotentially of the low-voltage conductors of cable and second, the continuity of the transfer of ground to the ground of the second connection device; and an insulating element conferring on the male device good mechanical strength and the desired dielectric properties;

b. a second connection device termed a female projection or extension piece comprising:

a central electrically conductive elastic female contact capable of receiving the high-voltage male contact;

an insulating elastic body capable of ensuring simultaneously the high-voltage insulation of the male device and its impermeability;

a ground reestablishment device accepting the transfer of the ground and equipotentiality from the male device;

a locking device ensuring the retention of the male device in the female device and allowing visual inspection of the insertion.

According to the invention, the high-voltage male contact comprises one cylindrical, electrically conductive piece.

According to the invention, the oblong-sectioned ring ensures the junction and the equipotentiality of the two low-voltage cable conductors because the narrow part of this ring clamps onto the cable.

According to another feature of the invention, the continuity of transfer of ground to the ground of the female device is produced by means of two bosses having, for example, a square section positioned on the oblong-sectioned ring made of a shape-retention alloy.

According to another invention feature, the insulating element comprises insulating resin which adheres perfectly to the male plug connector thus obtained.

According to the invention, the male plug connector further comprises two bevelled sides which, when inserted in the female device, compress the insulating body of this female device, thereby ensuring its impermeability, especially to air, cross-wise and at the point of connection when the male plug is inserted.

According to the invention, the ground reestablishment device comprises two flexible metal contact elements which come into contact with the two bosses on the male plug.

According to the invention, the locking device comprises, first, two ceramic balls placed in the female device and second, two housings in the male plug, these balls being held within these housings and kept embedded by an outer ring held in place by a spring.

BRIEF DESCRIPTION OF THE DRAWINGS

The feature and advantages of the invention will be better understood from the following description provided by way of example with reference to the attached drawings, in which.

DESCRIPTION OF PREFERRED EMBODIMENT

Figure 1:
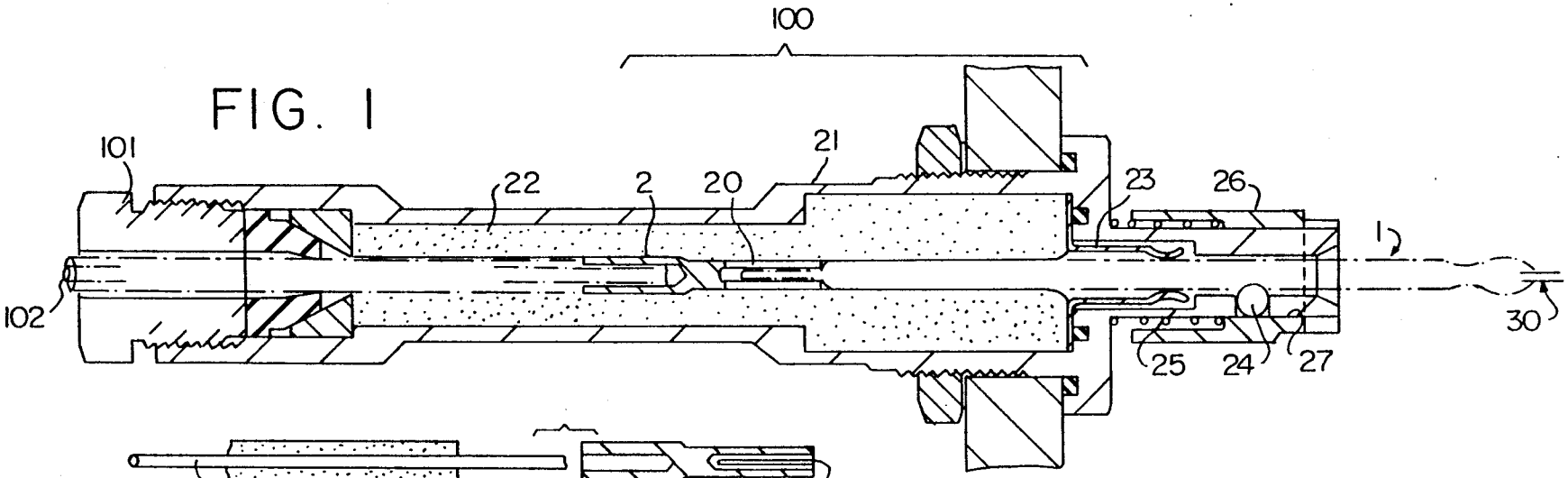
FIG. 1 is an overall view of a longitudinal section of the connector according to the invention, mounted on an extension piece.

FIG. 1 shows the entirety of the connector in longitudinal section. The connector comprises two complementary devices. The device attached to the flat cable 30 is termed the male plug 1. The female device 100 may be formed either as a projection fastened on a panel or as an extension piece. It is this female device which comprises, according to the invention, the locking elements so as to obtain a male plug having the smallest possible section.

The female device 100 is designed to receive a cable 102, for example a coaxial cable, and comprises, at the end in which the coaxial cable is inserted, a packing box 101 which immobilizes this cable in the device.

The flat metal-clad cable 20 is housed in the male plug 1 and comprises, as will be described more specifically with reference to FIGS. 6 and 7, a central high-voltage conductor and two low-voltage equipotential conductors. The central high-voltage conductor is connected to an electrically conductive male contact 10 of the male plug. The low-voltage conductors are connected to a ground-reestablishment device comprising two metal contact plates 23 positioned in the female element 100.

After the insertion of the male plug in the female device (a projection piece in the examples selected), the male contact 10 made of an electrically conductive material is clamped by an electrically conductive fork forming the female contact 20 located on the projection piece 21.

The female device 100 also comprises a locking device 24, 25, 26 which ensures:

the retention of the male plug 1 in the female element 100 in all cases of stress and environmental impact, for example a missile;

visual inspection guaranteeing the correct insertion of the male plug using a colored mark 27.

This locking device comprises two balls 24, made, for example, of ceramics, held immobilized in the end of the projection piece having a rectangular section and held embedded in two housings 38 located on the male plug 1 by means of an outer ring 26 held in place by a spring 25.

Figure 2:
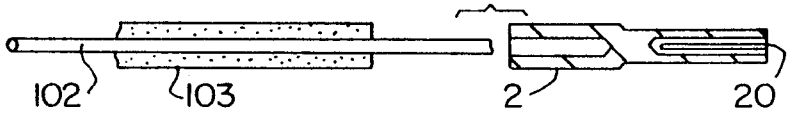
FIG. 2 represents the mounting of the cable 102 in the female contact element.

FIG. 2 shows the cable 102 before insertion in part 2 of the female extension piece. When the cable is inserted in the female extension piece, the cable is stripped, the stripped part being soldered, for example, on the inside of the female piece 2.

Figure 3:
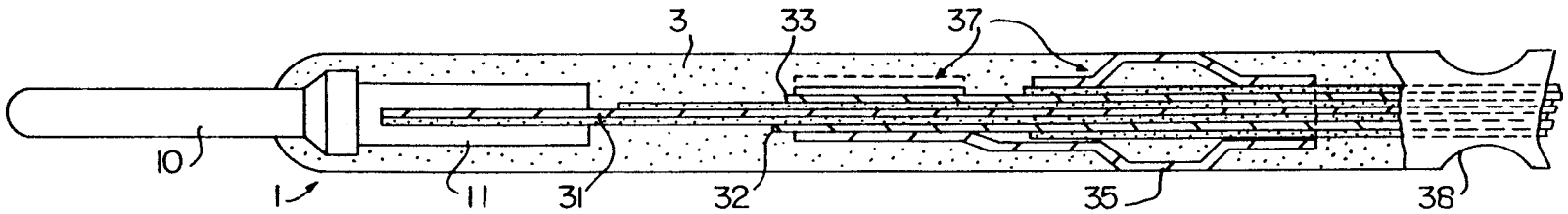
FIG. 3 is a detailed longitudinal section of the male plug.

FIG. 3 illustrates the male plug 1 seen in longitudinal section. This figure shows in detail all of the components forming this plug. The male contact 10 is preferably cylindrical in shape and is prolonged within the plug, i.e., on the side facing the flat cable 30, by a fork 11 made of a shape-retention alloy. The two low-voltage lines 32, 33 in the cable are held together by means of a ring 37 having an oblong section and made of a shape-retention alloy. This ring provides the following functions:

the junction and equipotentiality of the two low-voltage lines 32, 33 of the flat cable, by clamping on this cable the narrow part 36 of the oblong-sectioned ring made of a shape-retention alloy;

the continuity of transfer of ground to the ground of the female element 100 by means of two bosses 35 on this ring, these bosses having, for example, a square section.

The flat cable thus equipped is coated with an insulating material 3, for example a resin which adheres completely (e.g., Eccobond 45 ), thus conferring on the male plug both good mechanical resistance and the desired dielectric properties.

Figure 4:
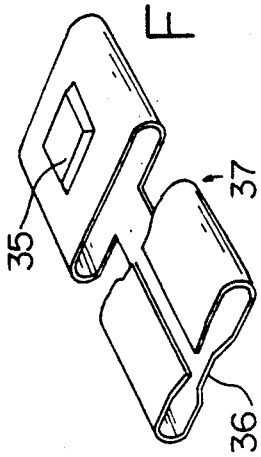
FIG. 4 is an overall view of the ring 37 in the male plug.

The oblong-sectioned ring 37 is shown in perspective in FIG. 4. This ring thus comprises a clamped part 36 and another part incorporating the bosses 35.

Figure 5:
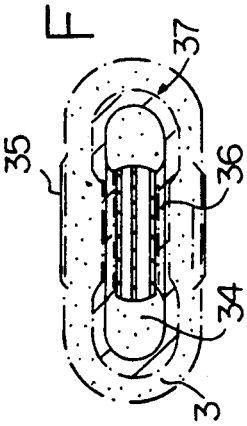
FIG. 5 is a transverse section of the clamped part of the ring in FIG. 4.

FIG. 5 is a transverse cross section of the male plug in the area of the clamped part of the ring 37. FIG. 5 thus illustrates the clamping function of the ring 37, which ensures the junction and equipotentiality of the two low-voltage lines of the flat cable 30.

Figure 6:
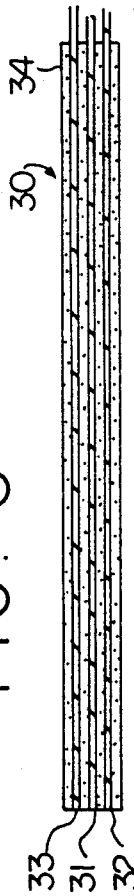
FIG. 6 is a section of the flat metal-clad cable made along a longitudinal plane.
Figure 7:
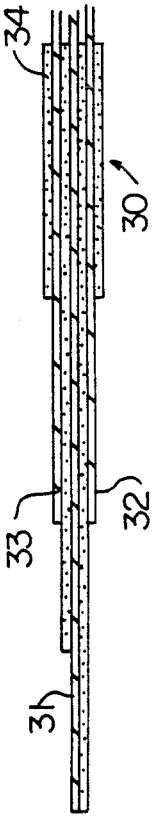
FIG. 7 shows the cable after its connectors have been stripped away.

FIGS. 6 and 7 illustrate the layered structure of the flat metal-clad cable 30. In fact, FIG. 6 shows the flat metal-clad cable in longitudinal cross-section. The high-voltage conductor 31 is placed between two insulating layers 34 on which the low-voltage conductors, 32 and 33 respectively, are positioned.

FIG. 7 illustrates the flat metal-clad cable 30 after the ends of the conductors have been stripped away, allowing the cable to be inserted in the male plug 1.

Figure 8:
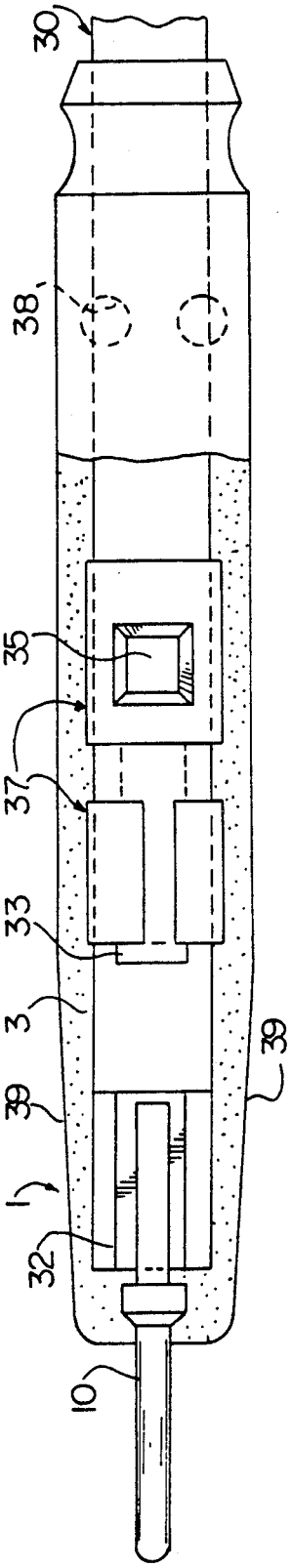
FIG. 8 is an overall view of the male plug.

FIG. 8 shows the male plug in its entirety, a part of this plug having been partially removed to show the positioning of the ring 37 inside the plug.

This figure also shows the housings 38 designed to house the balls 24 contained in the locking device of the female device.

To provide both high-voltage insulation of the male plug 1 and impermeability, the female device 100 further comprises an elastic insulating body 22, for example an elastomer (silicone or an equivalent material) having a suitable section.

Impermeability is ensured across the assembly and at the point of connection during the insertion of the male plug 1. The latter has, in fact, two bevelled sides 39 which, when inserted in the projection piece 21, compares the elastomer 22, which itself has a suitable shape. The lateral stress exerted on the elastomer 22 is distributed over the upper and lower surfaces of the male plug, thus ensuring the close contact of the elastomer over the entire periphery of the male plug.

We claim:

1. Male contact device, said device being connected to a first metal-clad cable comprising a stack of three conductors, namely, one high-voltage conductor (31) and two low-voltage equipotential conductors (32, 33), wherein said device comprises:

(a) an electrically conductive male contact (10) at an end of said high-voltage conductor (31);

(b) a fork (11) made of shape-retention material and capable of holding said high-voltage conductor (31) immobilized;

(c) an oblong-sectioned ring (37) made of a shape-retention material ensuring both junction and equipotentiality of continuity of transfer of ground to the ground of a device to which it is to be connected.

2. Male contact device according to claim 1, wherein said device further comprises an insulating element (30) conferring on said male device (1) good mechanical resistance and desired dielectric properties.

3. Male contact device according to claim 1 or 2, wherein said male contact (10) is elongated.

4. Female contact device connected to a coaxial cable and comprising:

(a) a central female contact forming an electrically conductive elastic clamp connected on a coaxial cable side thereof to said central high-voltage conductor of said cable;

(b) an elastic insulating body (22) enclosing said central female contact and capable of ensuring electrical insulation and impermeability; and (c) a device (23) for reestablishment of ground by transfer at an end of said insulating body (22).

5. Female contact device according to claim 4, wherein said device further comprises a locking device (24, 25, 26) ensuring retention of a male device capable of being connected to said female device.

6. Miniature connector for flat metal-clad cables comprising a stack of three conductors, namely, one high-voltage conductor (31) and two low-voltage equipotential conductors (32, 33), said connector being designed to connect said flat cable (3) electrically, wherein said conductor comprises a male device (1) and a female device (100), said male device (1) comprising:

(a) on a functioning side, an elongated, electrically conductive male contact (10) at an end of said high-voltage conductor (31);

(b) on a cable side (3), a fork (11) made of a shape-retention alloy capable of holding said high-voltage conductor (31) immobilized; and (c) an oblong-sectioned ring (37) made of a shape-retention material and ensuring both junction equipotentiality of said low-voltage conductors (32, 33) in said cable (30) and continuity of transfer of ground to the ground of said female device (2);

and said female device (100) comprising:

(d) a central electrically conductive elastic female contact (2) capable of accommodating insertion of said high-voltage male contact (10);

(e) an elastic insulating body (22) capable of ensuring both the high-voltage insulation of said male device (1) and its impermeability; and (f) a device for reestablishment of ground (23) allowing transfer of said ground of said male device (1) and its equipotentiality.

7. Connector according to claim 6, wherein said male device further comprises an insulating element (3) conferring on said device (1) good mechanical resistance and desired dielectric properties.

8. Connector according to claim 6, wherein said female device further comprises a locking device (24, 25, 26) ensuring retention of said male device (1) in said female device (100) and enabling visual inspection of said insertion.

9. Connector according to any one of claims 6 to 8, wherein said oblong-sectioned ring (37) comprises a clamp (36) ensuring junction and equipotentiality of said two low-voltage conductors (32 and 33).

10. Connector according to any one of claims 6 to 8, wherein said female device comprises two elective conductive elements formed as two bosses (35) placed on said oblong-sectioned ring (37) to ensure continuity of transfer of ground from said male device (1) to said female device (100).

11. Connector according to any one of claims 6 to 8, wherein said insulating element (30) of said male device (1) is formed from insulating resin which adheres completely to said male device.

12. Connector according to any one of claims 6 to 8, wherein said male device (1) further comprises two bevelled sides which, when said device is inserted in said female device (100), compress said insulating body (22) of said female device, thus ensuring impermeability cross-wise and at a point of connection when said male device (1) is inserted.

13. Connector according to any one of claims 6 to 8, wherein said ground-reestablishment device (23) is formed from two flexible metal contact plates (23) coming into contact with said two bosses (35) of said male device.

14. Connector according to any one of claims 6 to 8, wherein said locking device (24, 25, 25) comprises two balls (24) placed in said female device and two housing (36) positioned in said male device, said balls being held immobilized and embedded in said housings by means of an outer ring (26) held in place by a spring (25).

* * * * *